United States Patent [19]

Sopko

[11] Patent Number: 4,993,291

[45] Date of Patent: Feb. 19, 1991

[54] KEY CUTTING APPARATUS

[75] Inventor: Riley M. Sopko, Palos Verdes Estate, Calif.

[73] Assignee: Keymak Company, Anaheim, Calif.

[21] Appl. No.: 206,187

[22] Filed: Jun. 13, 1988

[51] Int. Cl.[5] ..... B26F 1/12

[52] U.S. Cl. ..... 83/39; 83/459; 83/560; 83/917

[58] Field of Search ..... 83/413, 414, 459, 559, 83/560, 917, 375, 556, 13, 39

[56] References Cited

U.S. PATENT DOCUMENTS

| | | | |
|---|---|---|---|
| 2,051,139 | 8/1936 | Griffith | 83/414 |
| 3,971,278 | 7/1976 | Wich | 83/413 |
| 3,981,214 | 9/1976 | Wich | 83/414 |
| 4,019,415 | 4/1977 | Wich | 83/413 |

*Primary Examiner*—Hien H. Phan
*Assistant Examiner*—Eugenia A. Jones
*Attorney, Agent, or Firm*—Knobbe, Martens, Olson & Bear

[57] ABSTRACT

An apparatus for cutting a key blank, including a clamp for securing part of the key blank between the cutting edge of a punch and an aperture in a mating die. The die includes a surface for reinforcing part of the key blank when the key blank is in contact with the cutting edge of the punch. The apparatus further includes a resilient element for biasing the key blank away from the reinforcing surface and toward the punch when the key blank is secured between the cutting edge of the punch and the aperture.

18 Claims, 4 Drawing Sheets

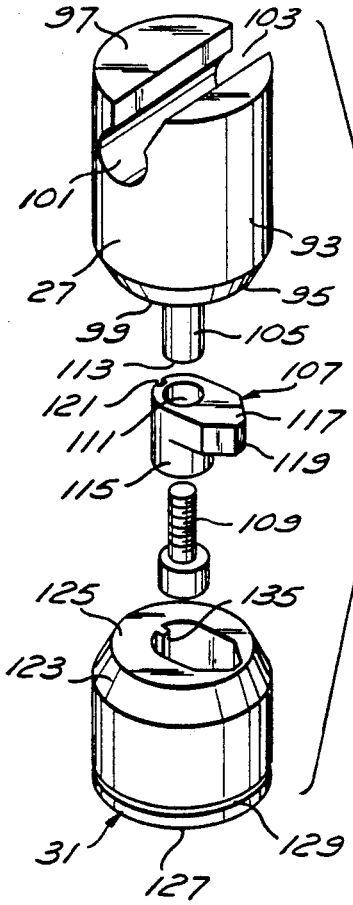
Fig. 4
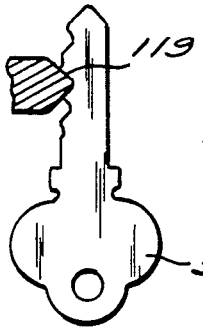
Fig. 7
Fig. 5
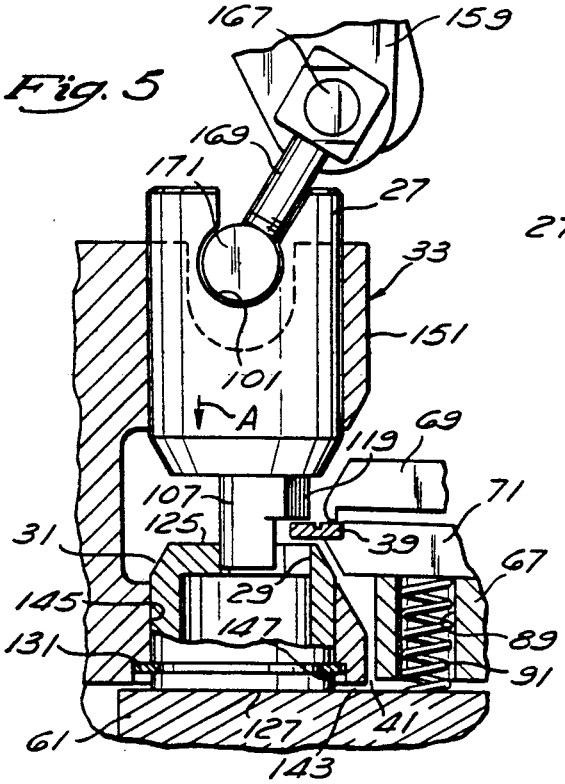
Fig. 6
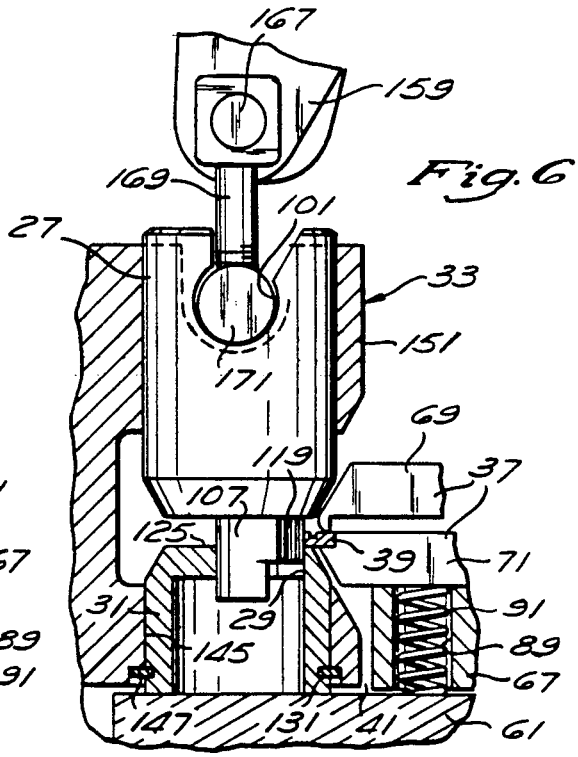

KEY CUTTING APPARATUS

BACKGROUND OF THE INVENTION

This invention relates to cutting apparatus and, in particular, to apparatus for cutting keys.

For purposes of illustration, this invention will be described in connection with coded key cutting machines as are described in U.S. Pat. Nos. 4,019,415 and 3,981,214. These key cutters utilize a reciprocating punch and die mechanism to cut notches in a key blank. The key blank is secured within the jaws of a vise, and the punch and die are moved along the operative edge of the key blank by a slide mechanism. The depth of the notches is controlled by means of moving the vise perpendicularly towards or away from the direction of the sliding punch and die. The notches are cut at standard notch locations along the length of the key based upon an analysis of a sample key or information obtained from the manufacturer of the lock. Since the sample key is only used to determine the desired standard depth of the notch to be made, rather than acting as a pattern for the cut, the inaccuracies of the sample are not transferred to the new key.

The precision of these cutting apparatus is, to a large extent, dependent on the precise alignment of the vise holding the key blank and the die. Unless the key blank is supported by the top surface of the die during the cutting process, the force exerted on the key by the punch will cause the key to bend, distorting the notches. On the other hand, if the die is too high, the friction of the key against the die will prevent the proper operation of the apparatus' slide mechanism. As a result, the manufacture of the apparatus is difficult due to the exacting tolerances which must be maintained to achieve this alignment. In addition, over time, the repeated exertion of force on the die during the cutting operation results in a certain amount of "play" being introduced into the slide mechanism of the punch and die holder causing the attendant potential for misalignment of the die and the vise.

Most keys incorporate at least one groove along one of their edges. Many keys are varied in thickness or include a step between this grooved portion and their notched or operative edge. The spacing of these grooves and the size of the step varies widely from manufacturer to manufacturer. As a result, the desired alignment between the die and vise of the apparatus changes depending on the manufacturer of the key being cut. Unfortunately, the cutting apparatus generally needs to be substantially dismantled to adjust this alignment.

Not only do key thicknesses and steps vary from manufacturer to manufacturer, however, but the shapes of the notches vary as well. As a result, when switching from cutting one manufacturer's key to another's, one must often replace the punch and die of the cutting apparatus. This too generally necessitates the substantial dismantling of the cutting apparatus. Due to the inconvenience of this procedure, it is common practice to purchase a number of coded key cutting machines to avoid the inconvenience and delay of changing punches.

Coded key cutting apparatus offer significant advantages in its simplicity, affordability and portability. There is needed, however, a durable key cutting apparatus for which the difficulties of aligning the vise and the die are minimized, and the quick and easy replacement of the punch and die is facilitated.

SUMMARY OF THE INVENTION

The invention is a key cutting apparatus, including a punch and a die, which incorporates a resilient element to support a clamp for securing part of a key blank the punch and a mating aperture in the die. Since the force of the cutting edge of the punch against the key blank is sufficient to overcome the bias of the element, and to drive the key blank against the surface of the die, the precise alignment of the vise and the die prior to cutting is not critical.

In one embodiment of the invention, the apparatus includes a movable holder for controlling the movement of the die along the operative edge of the key blank when the key blank is secured by the clamp. As the resilient element biases the key blank away from the reinforcing surface of the die, the likelihood that the key blank will interfere with the movement of the holder is diminished. Desirably, the holder does not limit the movement of the die away from the punch along an axis parallel to the cutting movement of the punch. As a result, the force of the cutting process is not borne by the holder, thereby significantly reducing wear and tear on the holder and reducing error in the cutting operation.

Another aspect of the invention is an apparatus for cutting a key blank having an improved guide and slide for controlling the transverse movement of a die holder. The apparatus includes a generally L-shaped base having a vertical stem portion and an elongate horizontal foot portion. A clamp is movable along the length of the foot portion of the base for securing part of a key blank between the cutting edge of a punch and the mating aperture of a die. The guide and slide do not bear the load of the cutting process, but are supported by the stem portion of the base and cooperate to permit the holder to move transversely relative the base while preventing the vertical movement of the holder.

DESCRIPTION OF THE DRAWINGS

These and other features of the invention will now be described with reference to drawings of a preferred embodiment which is intended to illustrate, and not to limit, the invention, and in which:

FIG. 4 is an exploded perspective view illustrating the punch and die of the apparatus of FIG. 1;

FIG. 5 is an enlarged cutaway elevational view illustrating the position of the apparatus of FIG. 1 prior to cutting a key;

FIG. 6 is an enlarged partially cut-away elevational view illustrating the punch and die of the apparatus of FIG. 1 immediately after a notch has been cut in a blank; and FIG. 7 is an illustration of the alignment of the cutting edge of a punch with a key blank.

DESCRIPTION OF THE PREFERRED EMBODIMENT

Figure 1:
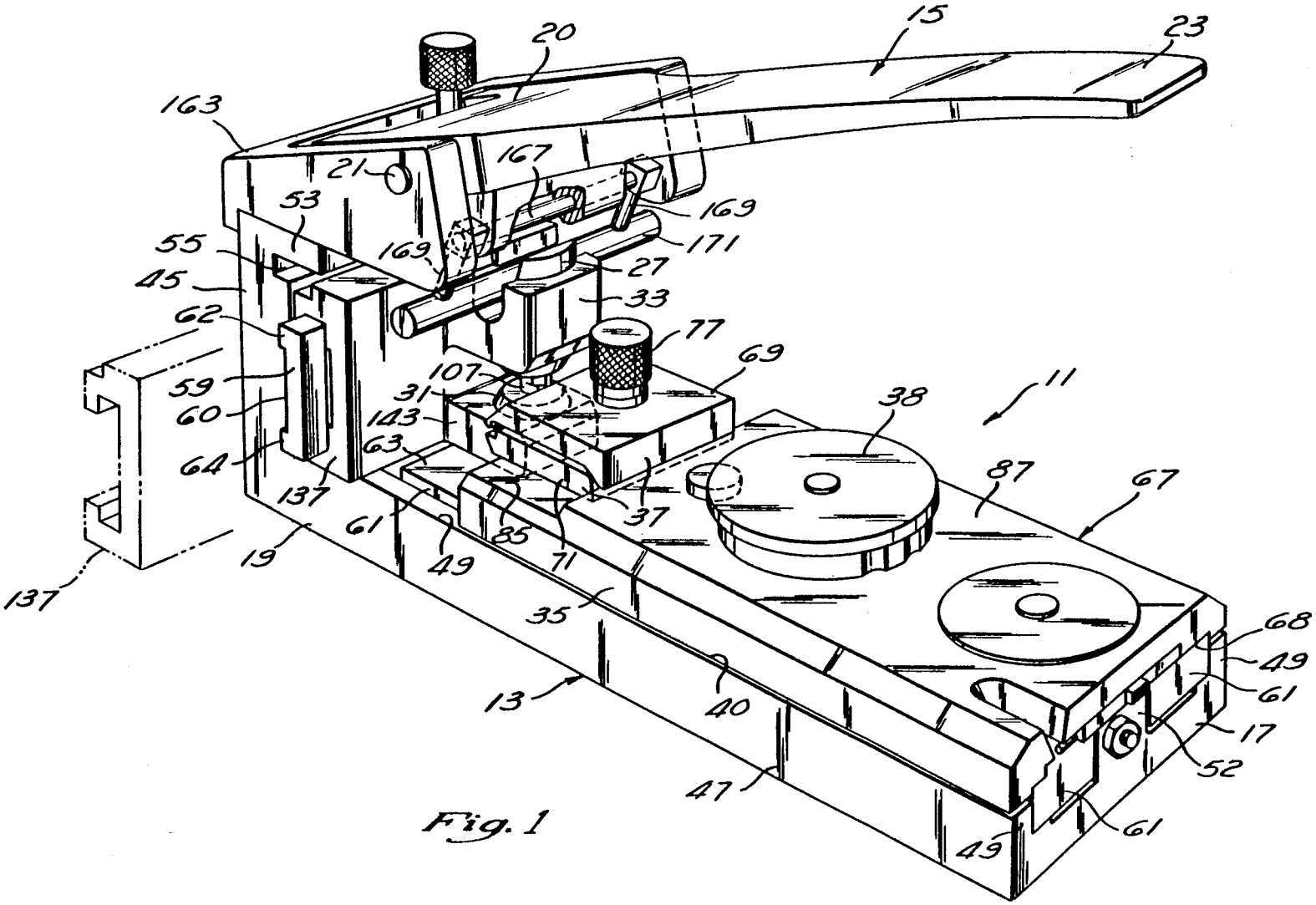
FIG. 1 is a perspective view illustrating a preferred embodiment of a key cutting apparatus made in accordance with the principles of the present invention.
Figure 3:
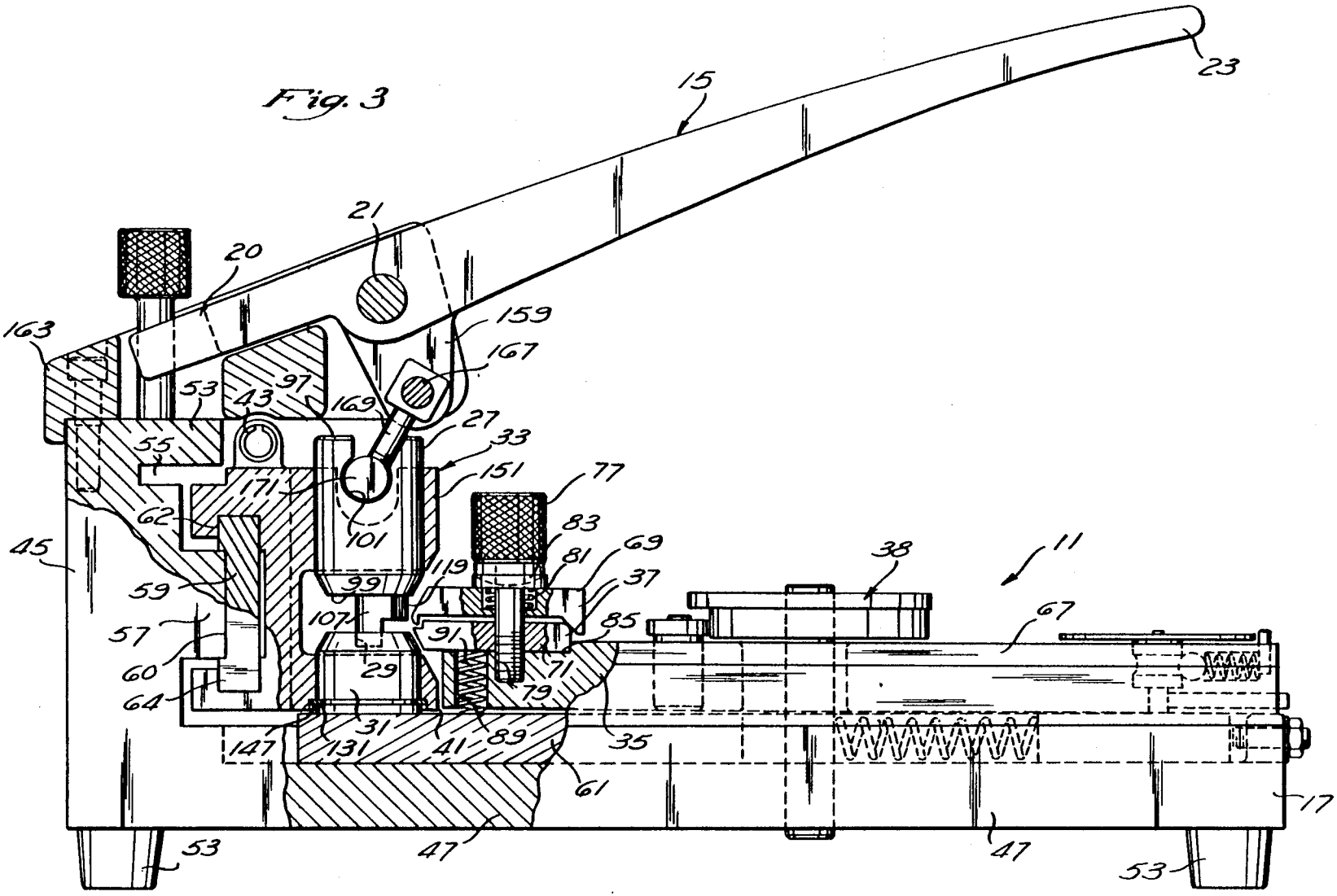
FIG. 3 is a partially cut-away elevational view of the apparatus of FIG. 1.

Referring to FIGS. 1 and 3, there is shown an apparatus 11 for cutting keys. The apparatus has an elongated base 13 and an elongated operating handle 15 which is disposed in a generally inclined relationship thereto. The base 13 has a forward end 17 and a rearward end 19. The rearward end 20 of the operating handle is pivotally supported above the rearward end 19 of the base upon a pivot shaft 21. The forward end 23 of the operating handle is disposed above the forward end 17 of the base. The forward end of the operating handle is normally somewhat elevated and is held in that position by means of one or more return springs which couple the rearward extremity of the handle (to the rear of the pivot shaft 21) to the rearward end of the base.

The operating handle 15 forms part of a drive mechanism utilized to vertically reciprocate a punch 27 within a mating aperture 29 in a die 31. The general horizontal alignment of the punch 27 with the die 31 is maintained by a punch and die holder 33.

The apparatus 11 is also provided with a key carriage 35, including a vise 37 or clamp for securing a key blank 39 between the punch and the die during the cutting operation. During cutting, the key blank 39 is disposed in a horizontal plane with its longitudinal axis extending transversely to the machine 11. The key carriage 35 is operated by means of a depth-setting mechanism 38 which moves the key carriage along a track 40 either closer or farther away from the punch and die holder 33.

Advantageously, the punch and die holder 33 reciprocates in a horizontal plane along a track 41 perpendicular to the axis of movement of the key carriage, thereby permitting a number of notches to be cut in a key blank without the necessity of removing the key blank 39 from the vise 37.

In general, the method of cutting a key is to first position a key blank 39 (FIG. 5) in the machine according to a particular notch that is to be cut in the blank, and then to manually depress the forward end 23 of the operating handle 15 causing the desired notch to be cut in the key blank by the punch and die mechanism. The release of the operating handle and its subsequent upward movement causes a ratchet mechanism (not shown) associated with the punch and die holder 33 to be released so that the punch and die holder is automatically advanced in a direction longitudinally of the key blank to the next notch location.

The punch and die holder 33 may move either from left to right or from right to left in its track 41 depending upon whether the key blank is to be cut commencing from its shoulder or from its tip end. A spring-loaded lock pin (not shown) is inserted into one of a pair of lock pin receptacles 43 to bias the punch and die holder in the desired direction. If the key blank is to be cut from left to right then the punch and die holder is placed in its right position and the spring-loaded lock pin is placed in the left receptacle 43, shown in FIG. 3. If the key blank is to be cut from right to left, then the punch and die holder is placed in its left position and the spring loaded lock pin is secured in the right receptacle 43 (not shown).

Figure 2:
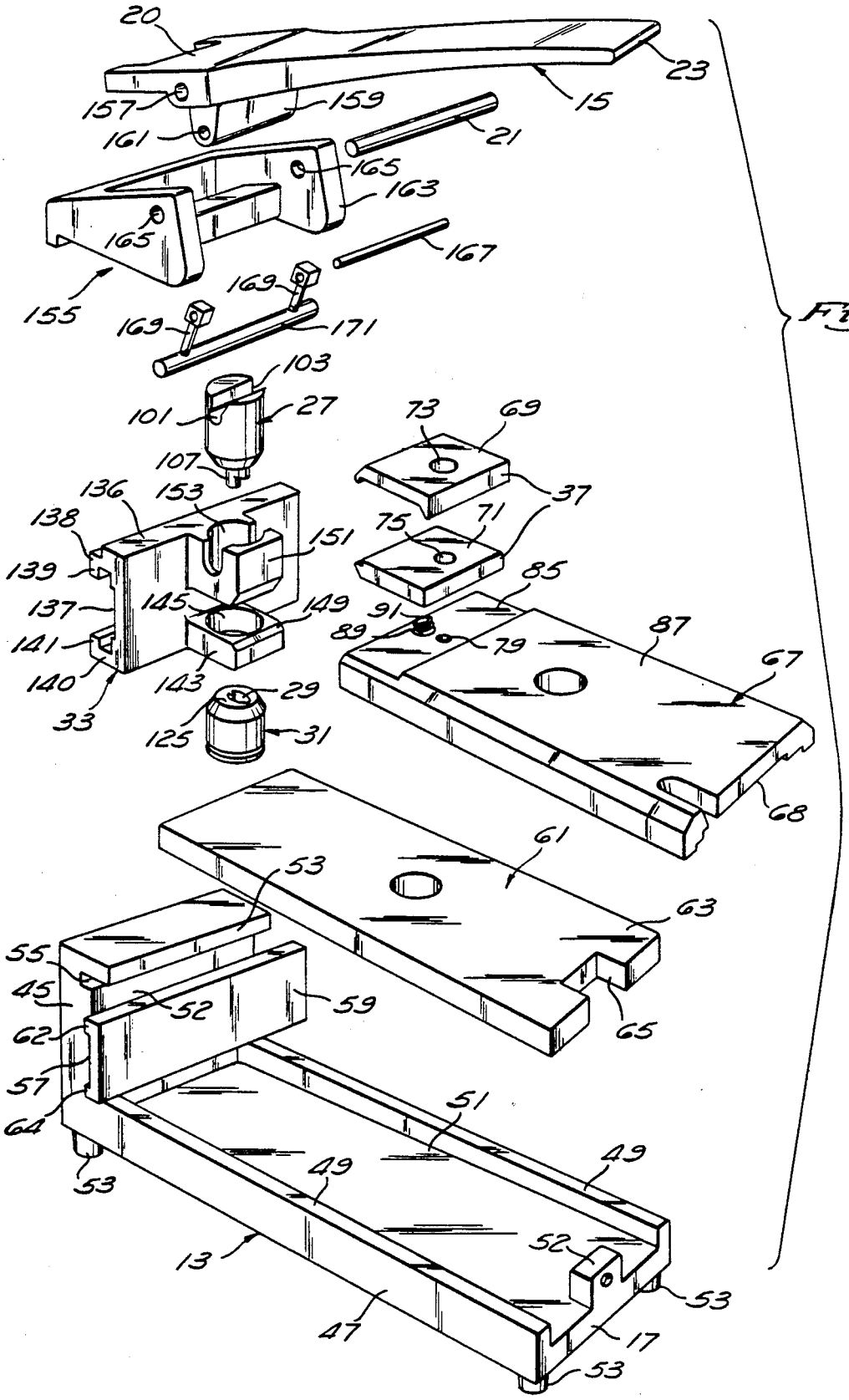
FIG. 2 is a exploded perspective view illustrating several components of the apparatus of FIG. 1.

Referring now to FIGS. 2 and 3, base 13 of the apparatus is generally L-shaped with a relatively short upwardly extending stem portion 45 and a relatively long horizontally extending foot portion 47. The foot portion 47 is generally rectangular and is provided with raised side flanges 49 along its length so as to form a rectangular trough 51. At the end of the foot portion opposite the stem portion 45 of the base approximately midway between the flanges 49, is an upwardly extending rectangular retaining block 52. The bottom corners of the foot portion are provided with rubber legs 53 secured to the base by suitable fasteners such as screws.

The stem portion 45 of the base 13 is generally rectangular and includes an upper overhanging flange 53. Immediately beneath the flange 53 is a horizontal channel 55 extending transversely across the base. Approximately midway between the channel 55 and the foot portion 47 is a rectangular projection 57 which extends over the trough 51 approximately the same distance as the overhanging flange 53. An elongate rectangular guide 59 or plate, longer than the base 13 is wide, includes a shallow channel 60 having a width approximately equal to that of the height of the projection 57 extending between an upper portion 62 and a lower portion 64. The guide 59 straddles and is secured to the projection 57 so that the upper portion 62 of the guide extends above the projection 57, and the lower portion 64 of the guide extends below the project 57. Thus secured, the guide 59 is positioned perpendicular to the flanges 49 of the foot portion so as to extend horizontally outward from the base 13 in either direction.

Referring now to FIG. 3, within the rectangular trough 51 formed by the base 13 is a generally rectangular standardization plate 61 or member having a substantially flat upper surface 63. As shown in FIGS. 1 and 3, the standardization plate 61 is somewhat shorter and taller than the trough and is provided with a rectangular notch 65 at one end for mating with the retaining block 52 of the base.

Referring to FIGS. 1, 2 and 3, straddling and supported by the standardization plate 61 is a generally rectangular carriage slide plate 67. As best seen in FIGS. 1 and 2, the lower surface of the carriage slide plate 67 is provided with a channel 68 slightly wider than the width of the standardization plate 61, but slightly shallower than the portion of the standardization plate extending above the flanges 49 of the base. Accordingly, when the slide plate 67 rests on the standardization plate 61 it is spaced slightly above the base and is able to slide longitudinally relative the base 13 while maintaining its alignment with the punch and die holder 33.

The front of the carriage slide plate 67 is stepped to provide a support for the key vise 37. The vise 37 has an upper jaw 69 and a lower jaw 71, each of which comprise generally rectangular plates, the rear edges of which are adapted to cooperate to secure a key blank 39 during the cutting process. The upper jaw 69 includes a cylindrical bore 73 extending through its center, the upper portion of which has a larger diameter than the lower portion. The lower jaw 71 includes a corresponding tapped vertical bore 75 extending through its center and having a diameter equal to that of the lower portion of the bore 73 extending through the upper jaw. The jaws of the vise are secured to the carriage slide plate 67 and to one another by means of a springed tightening bolt 77 which extends through the bores 73, 75 in the jaws and is secured within a tapped bore 79 extending through the upper surface of the carriage slide plate. A spring 81 is seated within the upper portion of the bore 73 of the upper jaw against the shoulder formed between the upper and lower portions of the jaws and is compressed between a washer 83 secured over the tightening bolt 77 and the shoulder between the upper and lower portions of the bore extending through the upper jaw. Preferably, the bore 79 in the carriage slide plate is positioned so that the lower jaw 71 is braced against the shoulder formed between the front portion 85 and rear portions 87 of the carriage slide plate.

Immediately to the rear of the tightening bolt 77 is a second cylindrical bore 89 extending through the carriage slide plate 67. As best seen in FIG. 3, a tensioned helical spring 91 is compressed within the bore 89 between the lower jaw 71 of the vise 37 and the upper surface 63 of the standardization plate 61, biasing the vise and the rear of the carriage slide plate upward.

Referring now to FIGS. 3 and 4, the punch 27 and die 31 of the apparatus will now be described The punch 27 includes a right cylindrical body 93 having an inwardly beveled surface 95 surrounding its lower outer edge. The beveled surface facilitates the free-sliding movement of the punch 27 relative the vise 37 and key carriage 35. The body 93 includes a substantially flat upper surface 97 and a substantially flat lower surface 99.

A horizontal bore 101, the axis of which is perpendicular to and intersects the vertical axis of the punch body 93 extends through the punch 27 and is connected to the upper surface 97 of the body by a generally triangular opening 103. The opening 103 conforms in shape to a right triangular wedge intersecting the horizontal bore 101 with one side parallel to the axis of the punch 27 and a second side including the upper surface of the punch 97.

Integrally formed with and coaxially extending from the center of the lower surface 99 of the punch is a cylindrical punch head holder 105. The punch head 107 is secured to the punch head holder 105 by means of a bolt 109 extending through a bore 111 in the punch head into a tapped bore 113 in the punch head holder. The punch head 107 includes a generally cylindrical vertical stem portion 115 and a generally oblong foot portion 117. At the end of the foot portion 117 opposite the stem portion 115 is a cutting edge 119, corresponding in shape to the desired standard notch configuration. Extending vertically along the stem portion 115 of the punch head opposite the cutting edge 119 is a vertical groove 121.

The punch 27 mates with a hollow right cylindrical die 31 having an inwardly beveled surface 123 surrounding its upper edge. The beveled surface is approximately equal in height to the lower jaw 71 of the vise 37 and, as with the punch, facilitates the free-sliding movement of the die 31 relative the vise 37 and the key carriage 35. The die 31 has a substantially flat upper surface 125 and a substantially flat annular bottom surface 127. Spaced slightly from the bottom surface 127 of the die is an annular groove 129 in which is secured an annular retaining ring 131.

A vertical aperture 29, the mouth of which precisely corresponds to the shape of the foot portion 117 of the punch head 107, extends through the upper surface 127 of the die. A vertical rib 135 shaped to mate with the groove 121 of the punch head extends into the aperture 29 parallel to the cutting movement A of the punch. Since there is only a minute amount of clearance between the cutting edge 119 of the punch and the mouth of the aperture 29, the mating groove 121 and rib 135 are used to prevent damage to the cutting edge 119 of the punch. Since the stem portion 115 of the punch cannot enter the mouth of the aperture 133 unless the rib 135 and groove 121 are properly aligned, the cutting edge of the punch is protected from inadvertent damage due to misalignment.

As best seen in FIGS. 1–3, the punch and die holder 33 is positioned to the rear of the key carriage 35 and is supported by the guide 59 extending from the stem portion 45 of the base 13. As best seen in FIG. 2, the punch and die holder 33 has a generally rectangular body 136, the rear surface of which forms a generally C-shaped slide 137 having an upper section 138 and a lower section 140. Extending along the length of the rear upper edge of the slide is a downwardly extending flange 139. Extending along the length of the rear lower edge of the slide is an upwardly extending flange 141. As best seen in FIG. 3, the upper section 138 of the slide surrounds the upper portion 62 of the guide on three sides, and the lower section 140 of the slide surrounds the lower portion 64 of the guide on three sides. The slide 137 and guide 59 cooperate to prevent the punch and die holder 33 from moving vertically relative the base 13 while permitting horizontal movement of the holder 33 only along an axis perpendicular to the axis of movement of the key carriage 35 (i.e., transverse to the base 13). Naturally, the slide could be fixed to the stem portion of the base and the guide secured to the holder.

Extending from the lower middle of the front of the punch and die holder 33 is a generally rectangular die holding portion 143. As best seen in FIGS. 2 and 3, the die holding portion 143 extends horizontally from the bottom of the body 136 of the punch and die holder, and includes a large vertically-oriented cylindrical bore 145 for receiving the die 31. As best seen in FIG. 3, the diameter of the bore 145 is slightly larger near the base of the slide 137, thereby forming a horizontal shoulder 147 for restricting the vertical movement of the retaining ring 131 and the die 31. In addition, the upper front surface 149 of the die-holding portion 143 is sharply beveled to ensure the free movement of the slide 137 relative the vise 37.

Extending from the upper middle of the front of the holder 33, directly above the die-holding portion 143, is a generally rectangular punch-holding portion 151. The punch-holding portion 151 is provided with a vertically-oriented cylindrical bore 153 coaxially aligned with the bore 145 of the die holding portion 143.

Referring now to FIGS. 2 and 3, the drive mechanism 155 of the punch will now be described The punch 27 is driven by an elongated operating handle 15 of generally rectangular shape at its forward end 23 and a wider forked rearward end 20. Spaced inward slightly from the rearward end is a first horizontal bore 157 extending through the width of the handle. Extending downward roughly perpendicular to the handle 15 from the first bore 157 is a lever arm 159, at the distal end of which extends a second horizontal bore 161. The handle 15 is secured to a generally C-shaped handle support 163 by a handle pivot shaft 21 which extends through the first bore 157 of the handle and through a mating aperture 165 in each side of the handle support 163. As shown in FIG. 3, the handle support is secured to the top of the stem portion 45 of the base 13 by suitable fasteners, such as bolts. A transmission shaft 167 extends through the second bore 161 through the lever arm 159 so as to extend outward on either side. A pair of drive links 169 and a punch pivot shaft 171 form a rectangle with the transmission shaft 167. Each end of the transmission shaft 167 is secured to a perpendicular extending drive link 169 which in turn is secured somewhat inward from the ends of the punch pivot shaft 171. The diameter of the punch pivot shaft 171 is approximately equal to that of the horizontal bore 101 extending through the punch 27.

As shown in FIGS. 1 and 3, when the handle 15 is in its undepressed state, forward end 23 of the operating handle is inclined upward from the rearward end 19 of the operating approximately thirty degrees. In this position, the handle 15 is supported by the handle pivot shaft 21 with the extreme rearward end of operating handle resting on the handle support 163. The lever arm 159 extends downward and approximately thirty degrees forward from the handle. The drive links 169 extend downward and approximately thirty degrees rearward from the transmission shaft 167 extending through the lever arm 159 to the punch pivot shaft 171 secured within the horizontal bore 101 extending through the body 93 of the punch 27. Even in this undepressed state, however, the stem portion 115 of the punch head 107 partially extends into the aperture 29 of the die, so that the alignment of the punch and die is maintained by the mating rib 135 and groove 121.

Operation

The operation of the cutting apparatus 27 will now be briefly described.

As shown in FIG. 5, a key blank 39 is secured between the jaws 69, 71 of the vise 37 in a horizontal plane with its longitudinal axis extending transversely to the apparatus parallel to the track 41 of the punch and die holder 33. The vise and the key blank secured thereby are biased above the flat upper surface 125 of the die 31 by the spring 91 compressed between the standardization plate 61 and the vise 37. Advantageously, the spring 91 biases the vise far enough above the support surface 125 of the die that any shape of key blank corresponding to the particular punch and die pair is spaced above the support surface of the die, but below the punch, to ensure that the punch and die can slide freely in a horizontal plane. The heights of the dies may be varied, to compensate somewhat for the shapes of the key blanks associated with their respective punches, to limit the amount which the spring 91 must bias the vise.

As shown in FIGS. 3 and 5, the movement of the punch and die along the operative edge of the key blank is controlled by the punch and die holder 33. The punch and die holder is secured to a guide which controls the movement of the holder. The upper portion 62 of the guide is positioned above the plane including the upper surface 125 of the die, generally parallel to the key blank. The lower portion 64 of the guide is positioned below the plane including the upper surface 125 of the die, generally parallel to the longitudinal key blank. As a result, the punch and die holder is movable parallel to the longitudinal axis of the key blank, but is prevented from moving perpendicular to or from rotating about this axis, thereby decreasing the possibility of error in the cutting operation.

After the key blank 39 has been secured, the punch and die holder 33 is slid along the guide 59 until the punch 27 is aligned with the position where the first notch will be cut from the key blank. Advantageously, the ratchet mechanism is calibrated to stop at this location when the key blank is secured within the vise at a predetermined position. In general, the position of the key blank will be set by means of aligning the key end or shoulder with a guide point.

When the longitudinal axis of the key blank is properly aligned parallel to the axis of the track 40 of the punch and die holder 33, the depth setting mechanism 38 is utilized to move the key carriage 35 inward or outward along an axis perpendicular to the track 40 of the punch and die holder. When the mechanism 38 is set to the proper depth, exactly that portion of the key blank 39 to be removed will extend between the aperture 29 of the die 31 and the punch 27.

The forward end 23 of the operating handle 15 is then manually depressed, causing the handle to pivot about the handle pivot shaft 21 and the transmission shaft 167 to move toward the rearward end 19 of the base 13 in an arc about the axis of the handle pivot shaft 21. This, in turn, causes the drive links 169 to force the punch pivot shaft 171 rearward and downward against the punch 27. As the horizontal movement of the punch 27 is constrained by the cylindrical walls forming the bore 153 of the punch-holding portion 151 of the punch and die holder, and the mating of the rib 135 of the die with the groove 121 of the punch head 107, the punch is driven vertically downward in a path precisely aligned with the die and the key blank 39.

As shown in FIG. 6, when the force of the punch 27 against the key blank 39 is sufficient to overcome the bias of the spring 91 between the standardization plate 61 and the vise 37, the key blank is driven downward until it rests against and is supported by the surface 125 of the die 31 surrounding the mouth of the aperture 29. At this point, the lower surface of the carriage slide plate 67 at the rearward end 19 of the apparatus is desirably spaced slightly above the standardization plate 61. This avoids the need for maintaining exacting tolerances in manufacturing the carriage slide plate and the lower jaw of the vise. In the alternative, the rearward end of the carriage slide plate and the lower jaw of the vise can be manufactured so as to precisely align the key blank with the upper surface 125 of the die when the force of the cutting edge 119 of the punch against the key blank 39 forces the rearward end of the carriage slide plate flush against the standardization plate. Since the die is directly supported by the standardization plate and since the key blank is only separated from the standardization plate by the lower jaw 71 of the vise 37 and the carriage slide plate 67, the difficulties of properly aligning the lower jaw of the vise with the upper surface 125 of the die are greatly reduced.

As the punch stroke is completed, the cutting edge 119 of the punch slices through the key blank 39 and is received within the aperture 29, dropping the cut-away material from the blank into the cavity formed by the hollow die and the standardization plate. Since the cutting edge 119 of the punch mates almost perfectly with the aperture 29 of the die, the portion of the key immediately surrounding the operative edge is prevented from bending by the upper surface 125 of the die. As the force or load of the cutting process is transferred by the die 31 directly to the standardization plate 61, rather than being borne by the guide or the C-shaped slide 137 of the punch and die mechanism, wear and tear on the slide 137 is greatly reduced, and wear of the slide does not introduce error into the cutting operation.

As the forward end 17 of the operating handle 15 is released, one or more return springs (not shown) secured to the end of the handle rearward from the handle pivot shaft 21 pull the rearward end 20 of the handle downward, thereby rotating the handle about its pivot shaft 21 and raising the forward end 17 of the handle.

Advantageously, a suitable ratchet mechanism drives the punch and die holder 33 horizontally along its track 40 to the position where the next notch is to be cut. As the slide 137 moves along the guide 59, the punch slides along the punch pivot shaft 171 and the die slides along the upper surface 63 of the standardization plate 61.

The operator then uses the depth setting mechanism 38 to move the key carriage 35 perpendicularly inward or outward to the proper depth, repeating the cutting procedure until each notch is cut.

As shown in FIG. 7, the cutting edge 119 of the punch corresponds precisely to the operative edge 173 of the key. Although each key manufacturer generally utilizes only a single notch configuration, varying only as to the depth of the notch, different manufacturers often utilize different standard notch configurations.

Desirably, the present invention permits the quick and easy change of punch and die pairs by means of sliding the punch and die holder 33 to one side until the punch 27 slides beyond the end of the punch pivot shaft 171, and the die 31 slides off the edge of the standardization plate 61 and the base 13. Advantageously, the bore 145 for the die holding portion 143 is at least as large as the bore 153 for the punch holding portion of the punch and die holder 33 to permit the punch and die to simply drop through the bore 145 of the die holding portion 151 of the punch and die holder. The desired punch and die pair can then be easily inserted up through the bore 145 whereby the punch and die holder 33 can be returned to a position over the apparatus so that the punch pivot shaft 171 is received by the bore 101 of the new punch and the die is supported within the die holder by the standardization plate 61.

I claim:

1. An apparatus for cutting a key blank, comprising:
a punch including a cutting edge;
a die forming an aperture for mating with said punch, said die including a surface for reinforcing part of said key blank when said key blank is in contact with said cutting edge of said punch;
a clamp for securing part of said key blank between said cutting edge of said punch and said aperture; and
a resilient element supporting said clamp for biasing said key blank away from said reinforcing surface and toward said punch when said part of said key blank is secured between said cutting edge of said punch and said aperture.

2. The apparatus of claim 1, further comprising a movable holder for controlling the movement of said die along the operative edge of said key blank when said key blank is secured by said clamp.

3. The apparatus of claim 2, wherein said holder controls the movement of said die transverse to an axis parallel to the cutting movement of said punch while permitting movement of said die away from said punch along said axis.

4. The apparatus of claim 3, further comprising an elongate guide, the length of which is perpendicular to the cutting movement of said punch, for controlling the movement of said holder along the operative edge of said key blank.

5. The apparatus of claim 3, further comprising a slide connected to said holder and a guide, said guide cooperating with said slide to control the movement of said holder.

6. The apparatus of claim 1, wherein said die additionally comprises a rib extending into said aperture parallel to the cutting movement of said punch and said punch additionally comprises a groove for receiving said rib prior to the mating of said cutting edge of said punch with said aperture of said die.

7. An apparatus for cutting a key blank, comprising:
a base;
a standardization member supported by said base;
a punch including a cutting edge;
a mechanism for driving said punch;
a handle for operating said mechanism;
a die supported by said member forming an aperture for mating with said punch; and
a holder supported by said base suspended above said member for controlling the movement of said die along said member and the operative edge of said key blank, while permitting the movement of said die toward said member.

8. The apparatus of claim 7, further comprising a guide perpendicular to said member for controlling the movement of said holder.

9. An apparatus for cutting a key blank, comprising:
a punch including a cutting edge;
a die having an aperture for mating with said cutting edge of said punch, said die including a surface for reinforcing part of said key blank when said key blank is in contact with said cutting edge of said punch;
a punch and die holder for aligning said punch with said die, said holder controlling the movement of said die transverse to an axis parallel to the cutting movement of said punch while permitting the movement of said die away from said punch along said axis, said holder including a slide;
a guide including a first portion located above a plane including said surface and a second portion located below a plane including said surface, said first portion and said second portion cooperating with said slide to prevent the vertical movement of said holder relative said guide while permitting said holder to move said die along the operative edge of said key blank.

10. An apparatus for cutting a key blank, comprising:
a punch including a cutting edge;
a die having an aperture for mating with said cutting edge of said punch, said die including a surface for reinforcing part of said key blank when said key blank is in contact with said cutting edge of said punch;
a punch and die holder for aligning said punch with said die, said holder including a slide;
a guide including a first portion located above a plane including said surface and a second portion located below a plane including said surface, said first portion and said second portion cooperating with said slide to prevent the vertical movement of said holder relative said guide while permitting said holder to move along the operative edge of said key blank; and
a clamp for securing part of said key blank between said cutting edge of said punch and said aperture and a resilient element for biasing said key blank away from said surface and toward said punch.

11. An apparatus for cutting a key blank, comprising:
a base;
a standardization member supported by said base;
a punch including a cutting edge;

a die resting against and supported by said member, said die forming an aperture to receive said cutting edge of said punch; and a die holder supported by said base suspended above said member limiting the movement of said die in a direction perpendicular to the cutting movement of said punch, while permitting the movement of said die toward said member.

12. An apparatus for cutting a key blank, comprising:

a base;

a standardization plate supported by said base;

a die resting against and supported by said plate;

a die holder, supported by said base, suspended above said plate for limiting the movement of said die along said plate, yet permitting movement of said die toward said plate; and a clamp for securing a part of said key blank over said die, said clamp supported by said plate.

13. The cutting apparatus of claim 12, wherein said die holder is movable along said standardization plate.

14. An apparatus for cutting a key blank, comprising:

a generally L-shaped base, including a vertical stem portion and a horizontal foot portion;

a punch including a cutting edge;

a die forming an aperture for mating with said punch;

a clamp supported by said foot portion for securing part of a key blank between said cutting edge of said punch and said aperture;

a punch and die holder for controlling the horizontal movement of said punch and said die; and a guide secured to said stem portion which suspends said punch and die holder above said foot portion of said base and controls the horizontal movement of said punch and die holder, said guide supporting said punch and die holder in such a manner that said guide and said punch and die holder permit the movement of said die toward said foot portion of said base.

15. The apparatus of claim 14, wherein said clamp is movable along said foot portion perpendicular to said horizontal movement of said punch and die holder.

16. An apparatus for cutting a key blank, comprising:

a generally L-shaped base having a vertical stem portion and a horizontal foot portion;

a handle supported by said stem portion;

a punch including a cutting edge;

a die forming an aperture for mating with said punch;

a clamp supported by said foot portion for securing part of said key blank between said cutting edge of said punch and said aperture;

a holder for controlling the horizontal movement of said punch and said die while permitting movement of said die toward said foot portion of said base;

a mechanism for driving said punch into said aperture of said die, said mechanism operated by said handle;

a guide having an upper portion and a lower portion in a spaced vertical relationship; and a slide including an upper section surrounding said upper portion of said guide on three sides and a lower section surrounding said lower portion of said guide on three sides, said guide and said slide cooperating to prevent the vertical movement of said holder relative said base while permitting the transverse movement of said holder relative said base.

17. The apparatus of claim 16, wherein said guide and said slide are supported by said stem portion of said base.

18. A method of cutting notches in a key blank with an apparatus, including a clamp, a punch and a die forming an aperture for receiving said punch, comprising the steps of:

securing said key blank within said clamp;

resiliently supporting said clamp so that said key blank is biased away from the upper surface of said die;

aligning said aperture of said die with the desired notch position on said key blank;

driving said punch against and through said key blank, forcing said key blank against the upper surface of said die and said punch into said aperture, thereby cutting a notch in said key blank;

disengaging said punch from said aperture and said key blank; and aligning said aperture of said die with the next desired notch position on said key blank.

* * * * *